US008191622B2

(12) United States Patent
Comeaux et al.

(10) Patent No.: US 8,191,622 B2
(45) Date of Patent: Jun. 5, 2012

(54) VARYING ACCESS POINTS FOR TUBING AND CASING MONITORING AND CASING ANNULUS REMEDIATION SYSTEMS

(75) Inventors: David D. Comeaux, Houston, TX (US); James J. Howell, Bryan, TX (US); Richard Porteous, Tipperty Ellon (GB); Noel A. Monjure, Cypress, TX (US); Frank C. Adamek, Spring, TX (US)

(73) Assignee: Vetco Gray Inc., Houston, TX (US)

( * ) Notice: Subject to any disclaimer, the term of this patent is extended or adjusted under 35 U.S.C. 154(b) by 296 days.

(21) Appl. No.: 12/469,489

(22) Filed: May 20, 2009

(65) Prior Publication Data

US 2009/0288832 A1 Nov. 26, 2009

Related U.S. Application Data

(60) Provisional application No. 61/054,666, filed on May 20, 2008.

(51) Int. Cl.
*E21B 19/08* (2006.01)

(52) U.S. Cl. ..... 166/88.4; 166/77.1; 166/77.2

(58) Field of Classification Search ..... 166/77.1, 166/77.2, 88.4, 90.1, 242.5, 277; 285/125.1, 285/197, 198, 199
See application file for complete search history.

(56) References Cited

U.S. PATENT DOCUMENTS

| | | | | |
|---|---|---|---|---|
| 4,972,904 | A * | 11/1990 | Godare | 166/90.1 |
| 5,027,903 | A | 7/1991 | Gipson | |
| 5,927,405 | A | 7/1999 | Monjure et al. | |
| 6,186,239 | B1 * | 2/2001 | Monjure et al. | 166/384 |
| 6,200,068 | B1 * | 3/2001 | Bath et al. | 405/184.1 |
| 6,289,992 | B1 | 9/2001 | Monjure et al. | |
| 6,315,046 | B1 * | 11/2001 | Jack et al. | 166/312 |
| 6,929,244 | B1 | 8/2005 | Law et al. | |
| 7,069,995 | B2 | 7/2006 | Chan et al. | |
| 7,309,058 | B2 | 12/2007 | Hunter et al. | |
| 7,686,091 | B2 | 3/2010 | Jennings et al. | |
| 2003/0111229 | A1 | 6/2003 | Clark | |
| 2011/0278007 | A1 * | 11/2011 | Howell et al. | 166/297 |

FOREIGN PATENT DOCUMENTS

| | | |
|---|---|---|
| GB | 2333307 A | 7/1999 |
| WO | WO98/57028 | 12/1998 |

OTHER PUBLICATIONS

Search Report from GB Patent Application No. GB1107685.8 dated Jul. 5, 2011 (3 pages).
Co-pending U.S. Appl. No. 12/779,468, filed May 13, 2010.

* cited by examiner

*Primary Examiner* — David Bagnell
*Assistant Examiner* — Richard Alker
(74) *Attorney, Agent, or Firm* — Bracewell & Giuliani LLP

(57) ABSTRACT

An adapter for connecting a casing annulus remediation system to a well having a wellhead with standard lateral ports. The adapter has a body with first and second ends. The first end of the adapter body has a substantially planar surface adapted to cover the lateral ports and be in abutting contact with the wellhead when the two are connected to one another. The second end of the adapter body has a planar surface positioned at an angle greater than 0 degrees and up to 90 degrees to the planar surface of the first end. The second end of the adapter is adapted to be connected to a casing annulus remediation system.

13 Claims, 10 Drawing Sheets

VARYING ACCESS POINTS FOR TUBING AND CASING MONITORING AND CASING ANNULUS REMEDIATION SYSTEMS

CROSS-REFERENCE TO RELATED APPLICATION

This application claims priority to provisional application 61/054,666, filed May 20, 2008.

FIELD OF THE INVENTION

This technique relates to adapters and equipment to provide varying access points for tubing and casing monitoring and casing annulus remediation systems.

BACKGROUND OF THE INVENTION

In wells drilled for petroleum production, a plurality of well casings of different sizes are suspended from a wellhead. A problem encountered in such wells is that of annular pressure control. In the annulus between different casing sizes, pressure may develop due to leaks between strings of casing. To control the pressure, a casing annulus remediation system is employed. The casing annulus remediation system comprises a hose that is inserted into an annulus between strings of casing. Often, the hose is inserted into the annulus through a lateral port that is often perpendicular to the casing, requiring the hose to maintain flexibility to accommodate the angle of entry. A nozzle is affixed to the lower end of the hose. The hose may be inserted several hundred feet into the well. Therefore, the hose must be pressurized and rigid to keep the hose from winding about the well. To keep the hose rigid, internal pressure is maintained in the hose. An angled access port would allow for the hose to be naturally more rigid. However, wells generally have standard lateral access ports.

A need exists for a technique that allows for more effective and efficient implementation of a casing annulus remediation system and subsequent insertion of a hose into an annulus. The following technique may solve one or more of these problems.

SUMMARY OF THE INVENTION

An apparatus and method for connecting a casing annulus remediation system to a well. The well has a wellhead with a longitudinal axis, a lateral port which is substantially perpendicular to the axis, and at least one string of casing supported in the wellhead and extending past the lateral port into the well, defining an annulus. The apparatus has a body with first and second ends. The first end of the body has a planar surface substantially parallel to the axis and is adapted to be in abutting contact with and connected to the wellhead, thereby covering the lateral port. The second end of the body has a planar surface positioned at an angle greater than 0 degrees and up to 90 degrees to the axis and is adapted to be connected to the casing annulus remediation system. A valve removal plug preparation is located in the planar surface of the second end of the body, and a valve removal plug is positioned within the valve removal plug preparation and is adapted to protect the valve removal plug preparation. A pilot hole is located in the planar surface of the second end of the body, perpendicular to the planar surface and is adapted to receive a drilling device.

The annulus of the well is sealed from the atmosphere by inserting a valve removal plug into the lateral port. The first end of the body is connected to the wellhead such that the planar surface of the first end substantially covers the lateral port and the valve removal plug. The shear capable valve of the casing annulus remediation system is connected to the planar surface on the second end of the body. An angled access port is created from the pilot hole, through the body, through the wellhead, and into the annulus. The remainder of the casing annulus remediation system is then connected to the shear capable valve.

In alternate embodiment, the body has a curved access port located in and extending through the body from the planar surface of the first end to the planar surface of the second end. The curved access port is aligned with the lateral port at the first end of the body.

DETAILED DESCRIPTION OF THE INVENTION

Figure 1:
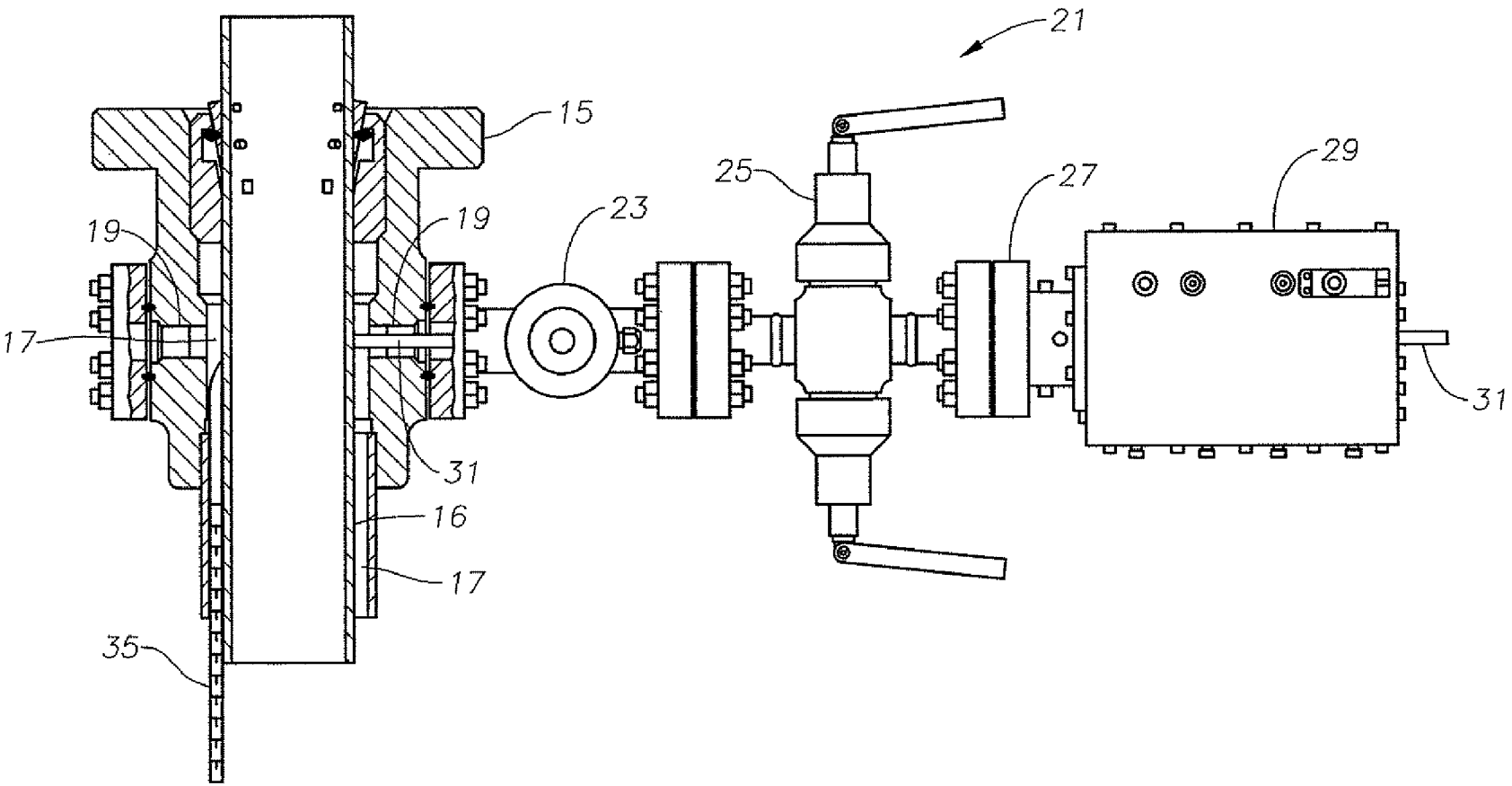
FIG. 1 is a schematic view of a wellhead with a remediation system connected to the wellhead.

Referring to FIG. 1, a wellhead 15 has annulus access ports 19 that permit access to an annulus section 17 of the well. In a typical wellhead 15, annulus access ports 19 are located on the wellhead 15, and run perpendicular to the well casing 16. In this embodiment, a casing annulus remediation system (CARS) 21 has been connected to the wellhead 15. In order to connect the CARS equipment 21 to the wellhead 15, a shear capable valve 23 is connected to port 19 on wellhead 15. A valve removal (VR) plug (not shown) is then removed from port 19 on the right side of the wellhead 15 through valve 23. An annular blowout preventer (BOP) 25 is then connected to the shear capable valve 23. A packoff 27 is located to the right of BOP 25, and a hose driver 29 is located to the right of packoff 27. Hose 31 is fed through the CARS equipment 21 by means of driver 29. An articulated weight device 35 is connected to the end of hose 31. The entry angle into annulus section 17 created by the orientation of access port 19 requires hose 31 to be extremely flexible. However, hose 31 must also be stiff enough to run downward through annular section 17 without winding or knotting occurring.

Figure 2:
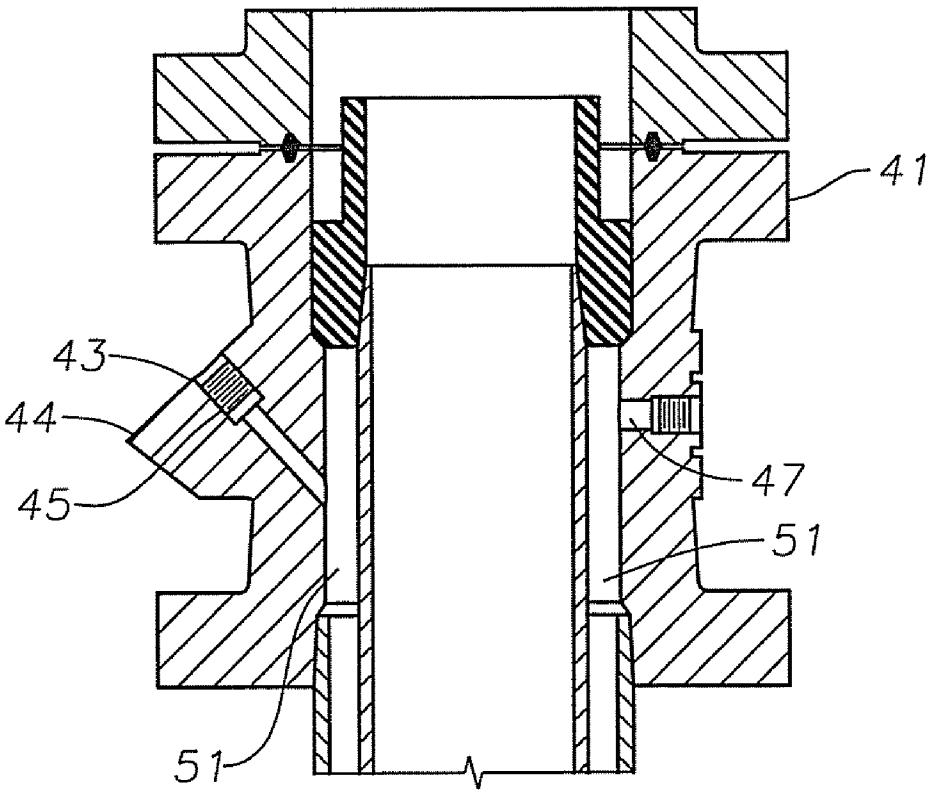
FIG. 2 is a schematic view of a wellhead manufactured with an angled entry port.

Referring to FIG. 2, in order to simplify the implementation of a CARS, wellhead 41 is manufactured with an angled annulus access port 43 with the prospect of running the CARS program at some later point in its life. Access port 43 forms an angle greater than zero (0) degrees, and less than ninety (90) degrees with the well casing/structure. Port 43 is angled for easy entry into the annulus 51. The interface surface 44 will be located ninety (90) degrees opposed to access port 43. Interface surface 44 will allow for CARS equipment 21 (FIG. 1) to be connected to wellhead 41. Access port 43 has threads along its inner surface. A valve removal (VR) plug 45 with threads along its outer surface is threaded into access port 43 until the CARS equipment 21 (FIG. 1) is connected to wellhead 41. The CARS equipment 21 (FIG. 1) is connected to wellhead 41, beginning with shear capable valve 23 (FIG. 1). VR plug 45 is then removed from port 43 and extracted through valve 23. Valve 23 is then closed, and whatever exists on the outside of the valve 23 is vented off. The remainder of the CARS equipment 21 (FIG. 1) is attached and the operating procedure for CARS is run. Access port 47 illustrates the standard port orientation. Angled access port 43 allows easier access to annular sections 51 with a hose or similar device. Additionally, the orientation of port 43 reduces the flexibility required of a hose or similar device that may be fed into annulus section 51.

Figure 3:
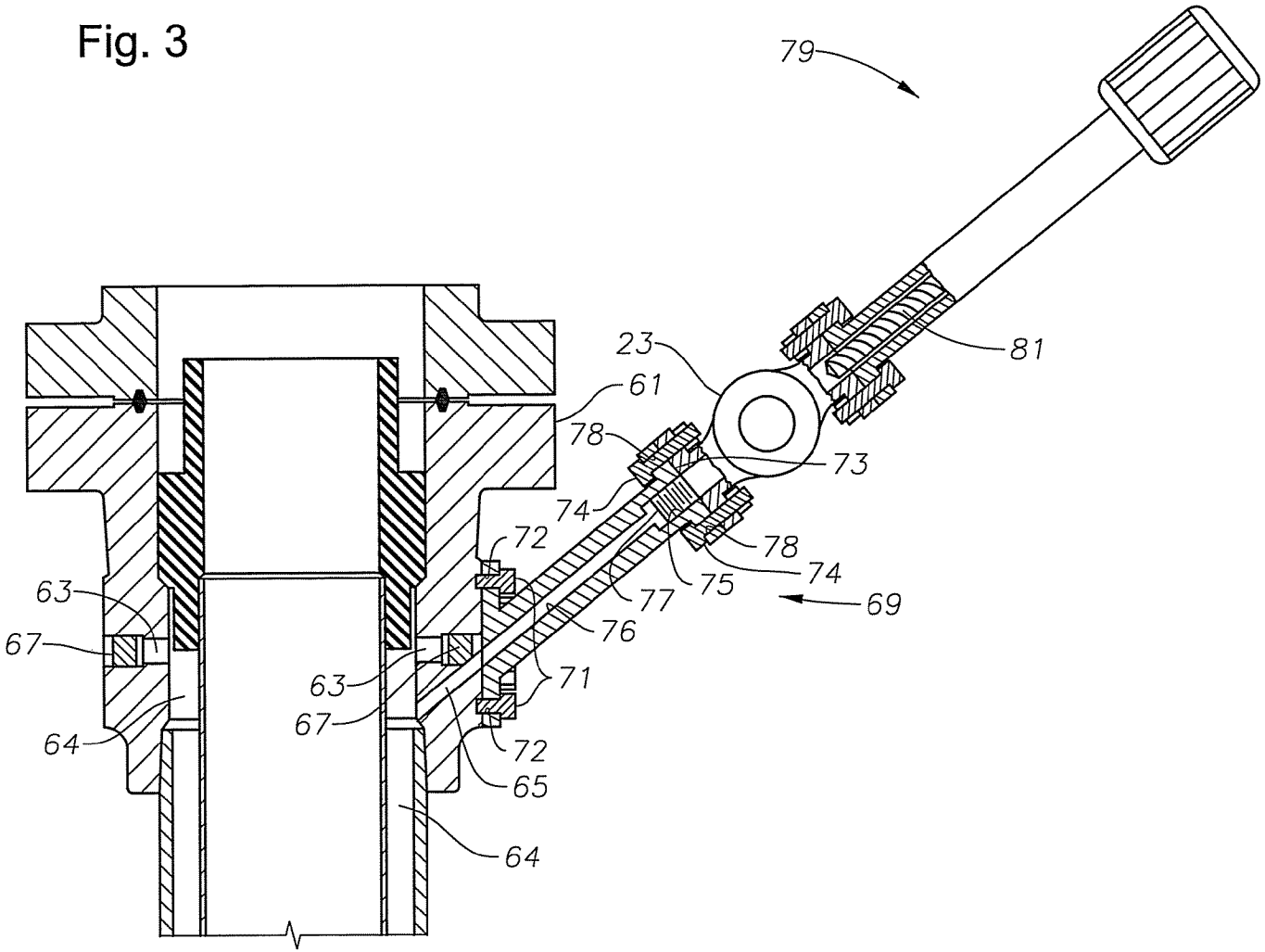
FIG. 3 is a schematic view of a wellhead with a remediation system adapter connected to the wellhead.

Referring to FIG. 3, in order to create an angled access port 65 for a wellhead 61 that contains standard access ports 63, CARS adapter 69 is employed. CARS adapter 69 is comprised of an interface surface 73, which is ninety (90) degrees opposed to angled access port 65. On the interface surface 73, a VR plug preparation 75 is located within adapter 69. VR plug preparation 75 has threads along its inner surface. A special VR plug 77 with a hole in it is initially threaded into VR plug preparation 75 and acts as a drill bushing and protects the threads of the VR plug preparation 75 during the installation of adapter 69. Adapter 69 also contains a pilot hole 76 for drilling access port 65.

In order to install adapter 69, the annulus 64 of wellhead 61 is shut off to the atmosphere by the use of VR plugs 67, which are placed in access ports 63. The VR plug 67 on the right access port 63 of wellhead 61 will be a permanent attachment to the wellhead 61 once adapter 69 has been connected. Adapter 69 is bolted to the wellhead by a series of bolts 71 that pass through a series of apertures 72 in the adapter 69. A seal (not shown) seals between wellhead 61 and adapter 69. After bolting up adapter 69 to the wellhead 61, the CARS shear capable valve 23 may be mounted to the interface surface 73. The CARS shear capable valve 23 may be bolted to the interface surface 73 of the adapter 69 by a series of bolts 74 that pass through a series of apertures 78 in the interface surface 73 of the adapter 69. A drilling device 79 with a drill 81 is mounted to valve 23 in preparation for entry into the wellhead 61. The drilling device 79 will have a seal such as is found on a VR extraction tool, as known in the art, to prevent anything from reaching the atmosphere as the drill 81 makes entry into the annulus 64 through the valve 23. The drilling device 79 will drill through adapter 69 starting at pilot hole 76. VR plug 77 allows the drill 81 to pass through it and ensures that the threads in VR preparation 75 are protected from damage due to drilling. After annulus 64 is opened by drilling through wellhead 61 to form passage 65, the drill 81 may be extracted, valve 23 closed, the open side of valve 23 vented and the special drilling tool 79 removed.

The wellhead 61 is ready for the remainder of the CARS equipment 21 (FIG. 1) to be mounted to the adapter 69 and used. After the use of the CARS equipment, the special VR plug 77 will be removed from the adapter and replaced with a standard VR plug (not shown), similar to VR plug 63. This plug is solid and does not have a hole in it. The adapter 69 may be a permanent fixture and remain with wellhead 61 throughout its life. The original VR plug 67 and thread in port 63 on the right side of wellhead 61 will not be re-usable as it will be drilled through, and will remain with the wellhead 61 throughout its life. If the CARS system is later re-attached to adapter 69, the standard VR plug (not shown), similar to VR plug 63 must be removed. In order to remove the standard VR plug, shear capable valve 23 is connected to adapter 69, and the standard VR plug is removed through it, before the remaining CARS equipment is connected.

Figure 4:
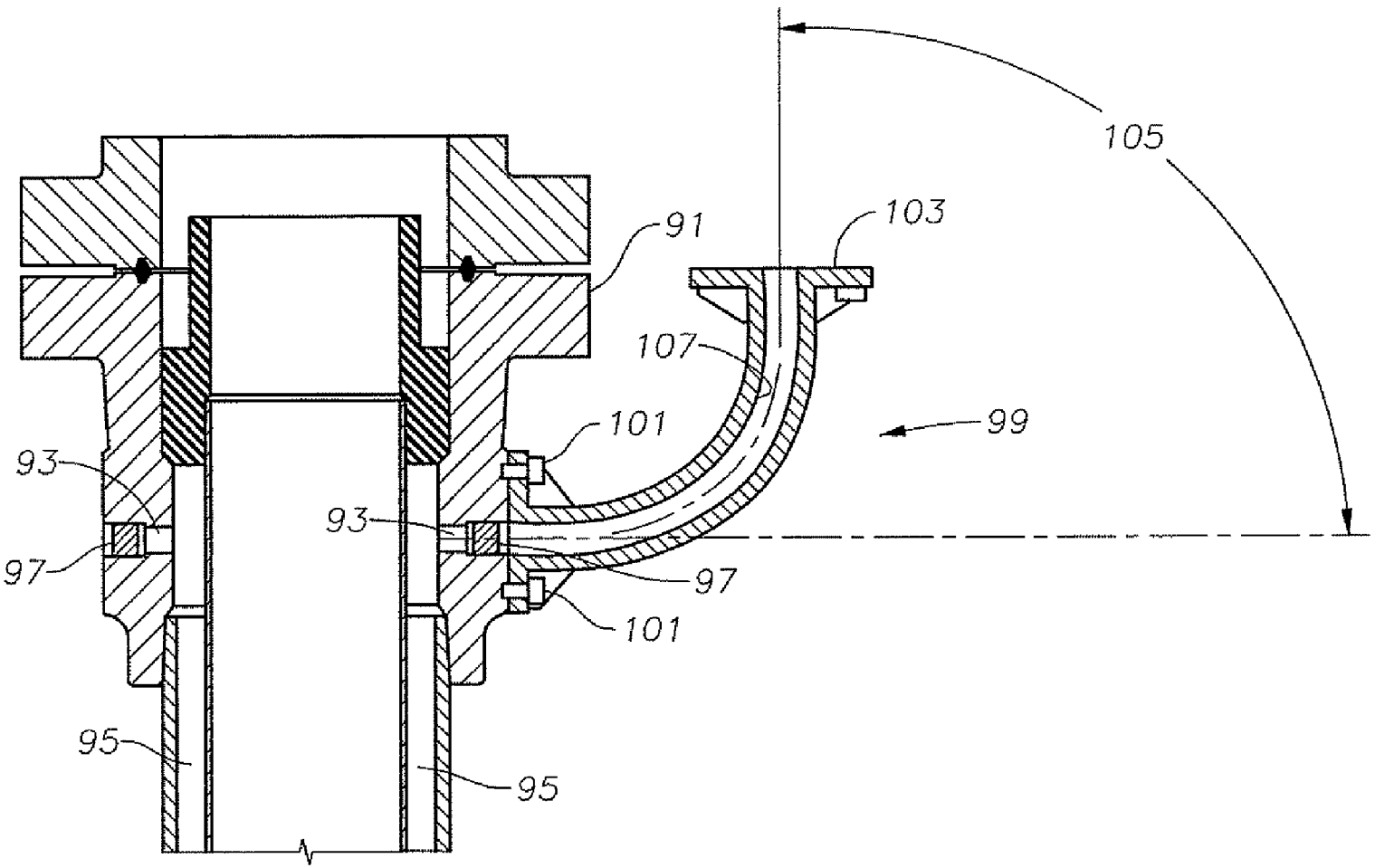
FIG. 4 is a schematic view of a wellhead with a standard remediation system adapter connected to the wellhead.

Referring to FIG. 4, CARS adapter 99 is employed in wellhead 91 where close proximity (such as a silo surrounding wellhead 91) prevents horizontal entry (FIG. 1) through access port 93. In order to enable entry into access port 93 on the right side of wellhead 91, angled CARS adapter 99 is employed. CARS adapter 99 is comprised of an interface surface 103, which can be positioned between zero (0) and ninety (90) degrees opposed to access port 93. The adapter 99 contains a curved passageway 107 whose radius of curvature is dependent upon the angle 105 between access port 93 and interface surface 103.

In order to connect CARS adapter 99 to wellhead 91, a VR plug 97 is set in access port 93 of wellhead 91. CARS adapter 99 is attached to wellhead 91 by a series of bolts 101. After bolting up adapter 99 to the wellhead 91, the CARS shear capable valve 23 (FIG. 1) may be mounted to the interface surface 103. Once the CARS valve 23 (FIG. 1) is mounted to the top of adapter 103, the VR plug 97 in access port 93 of wellhead 91 can be removed through valve 23. The atmospheric side of valve 23 can then be vented, and the remainder of the CARS equipment 21 (FIG. 1) is mounted and used. After the CARS service is performed, VR plug 97 can be re-inserted in access port 93 of wellhead 91 and adapter 99 can be removed to be used elsewhere. In FIG. 4, no drilling of wellhead 91 occurs, unlike drilling passage 65 in FIG. 3.

Figure 5:
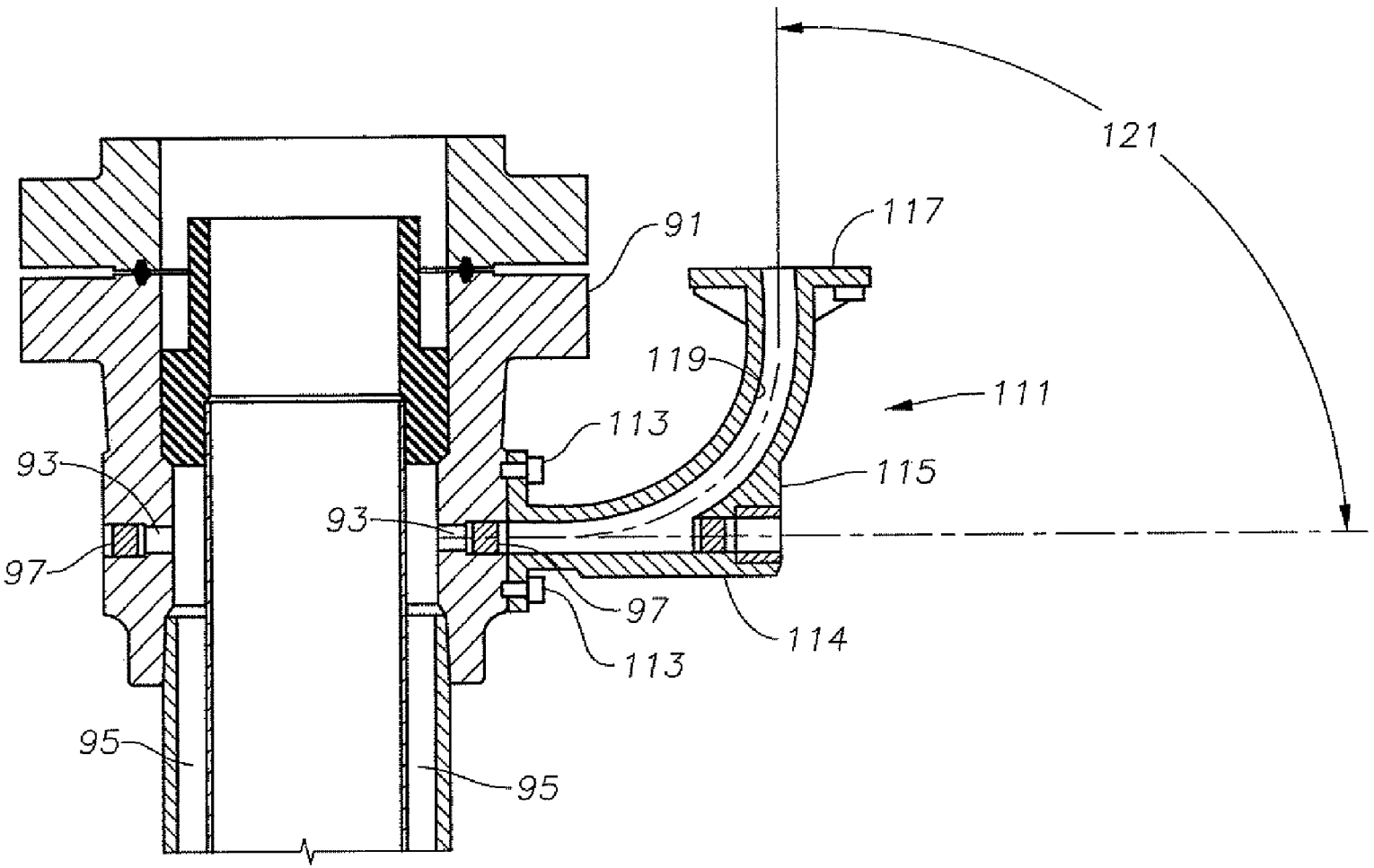
FIG. 5 is a schematic view of a wellhead with a custom vertical remediation system adapter connected to the wellhead.

FIG. 5 illustrates an alternate embodiment of adapter 99 of FIG. 4. CARS adapter 111 is employed in wellhead 91 where close proximity prevents full horizontal entry (FIG. 1), but allows sufficient stroke length to horizontally remove VR plug 97. In order to enable entry into access port 93 on the right side of wellhead 91, angled CARS adapter 111 is employed. CARS adapter 111 is comprised of an interface surface 117, which can be positioned from zero (0) and ninety (90) degrees opposed to access port 93. The adapter 111 contains a curved passageway 119 whose radius of curvature is dependent upon the angle 121 between access port 93 and interface surface 117. Adapter 111 also contains a VR plug preparation 114, and VR plug removal tool interface 115, both of which are positioned directly in line with port 93.

In order to connect CARS adapter 111 to wellhead 91, a VR plug 97 is set in access port 93 of wellhead 91, CARS adapter 111 is attached to wellhead 91 by a series of bolts 113. After bolting up adapter 111 to the wellhead 91, the CARS shear capable valve 23 (FIG. 1) may be mounted to the interface surface 117. Once the CARS valve 23 (FIG. 1) is mounted to the top of the adapter 111, a plug retrieval tool (not shown) is used to remove plug 97 from wellhead 91. This retrieval tool is inserted into tool interface 115 of adapter 111 and will remain in adapter 111 to continue sealing it off from the atmosphere until after the CARS operation is complete. The removal tool (not shown) removes VR plug 97 from access port 93, and secures the VR plug 97 in VR plug preparation 114 until the CARS operation is complete. The atmospheric side of valve 23 can then be vented, and the remainder of the CARS equipment 21 (FIG. 1) is mounted and used. After the CARS service is performed, VR plug 97 is re-inserted in access port 93 of wellhead 91 and adapter 111 can be removed to be used elsewhere.

Figure 6:
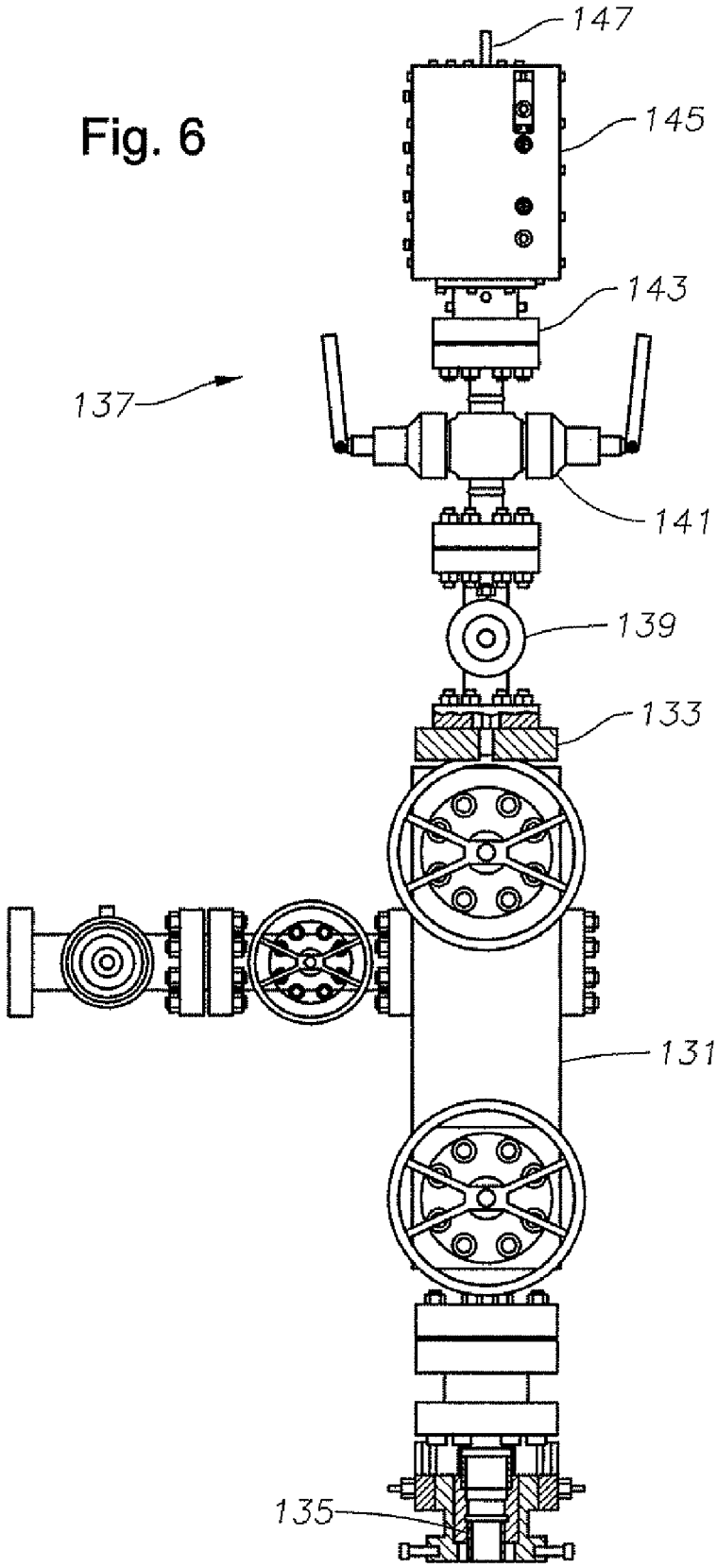
FIG. 6 is a schematic view of a wellhead tree with a vertical remediation system connected to the tree.

FIG. 6 illustrates "top" or "vertical" entry of the CARS equipment 137 into a wellhead tree 131 without the need for rigging. A standard tree cap (not shown) is replaced with a CARS interface adapter 133. The shear capable valve 139 will be mounted to the CARS interface adapter 133, and the remaining CARS equipment 137, including the annular BOP 141, packoff 143, and hose driver 145 are then assembled. FIG. 6 illustrates "vertical" entry of the CARS equipment 137 directly into the production tubing 135 of the wellhead tree 131. The CARS equipment 137, particularly hose 147 would be used inside of the production tubing 135 for implementation of various remediation systems.

Figure 7:
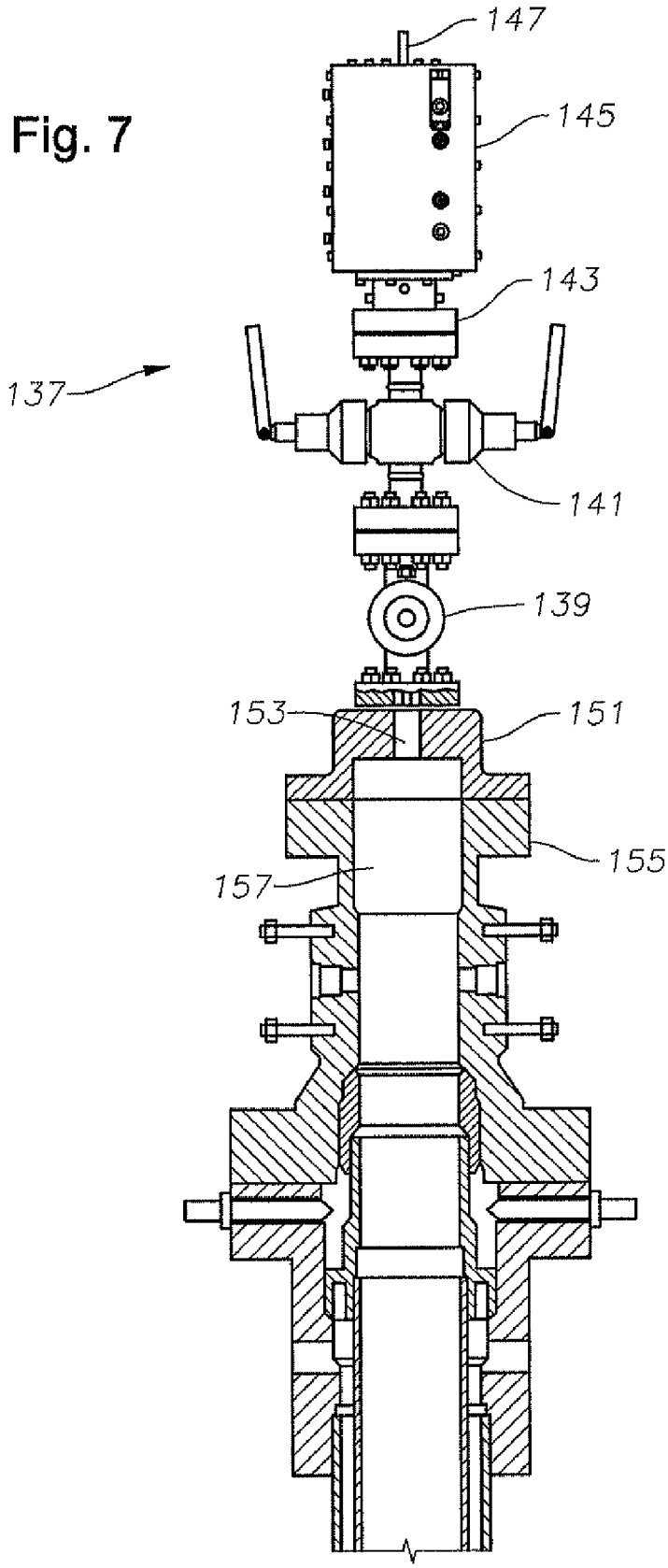
FIG. 7 is a schematic view of a wellhead with a vertical remediation system connected to the wellhead.

FIG. 7 illustrates "top" or "vertical" entry of the CARS equipment 137 into a wellhead 155 without the need for rigging. A standard wellhead cap (not shown) is replaced with a CARS interface adapter 151. The shear capable valve 139 will be mounted to the CARS interface adapter 151, and the remaining CARS equipment 137, including the annular BOP 141, packoff 143, and hose driver 145 are then assembled. FIG. 7 illustrates "vertical" entry of the CARS equipment 137 through access port 153 directly into the production casing 157 of wellhead 155, with the production tubing pulled. The CARS equipment 137, particularly hose 147 would be used inside of the production casing 157 for implementation of various remediation systems.

Figure 8:
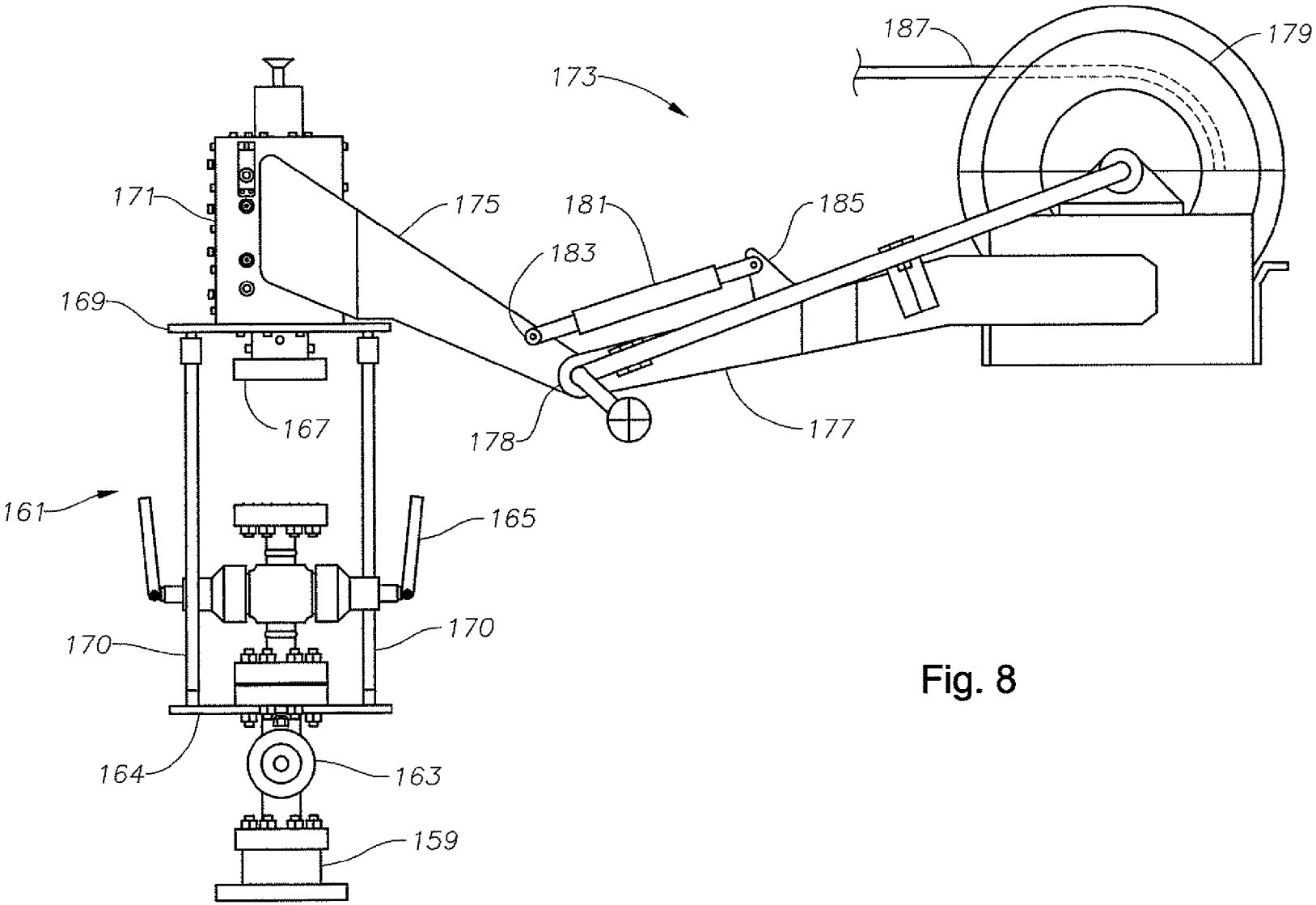
FIG. 8 is a schematic view of a vertical remediation system with lift and hose reel cylinder extended.
Figure 9:
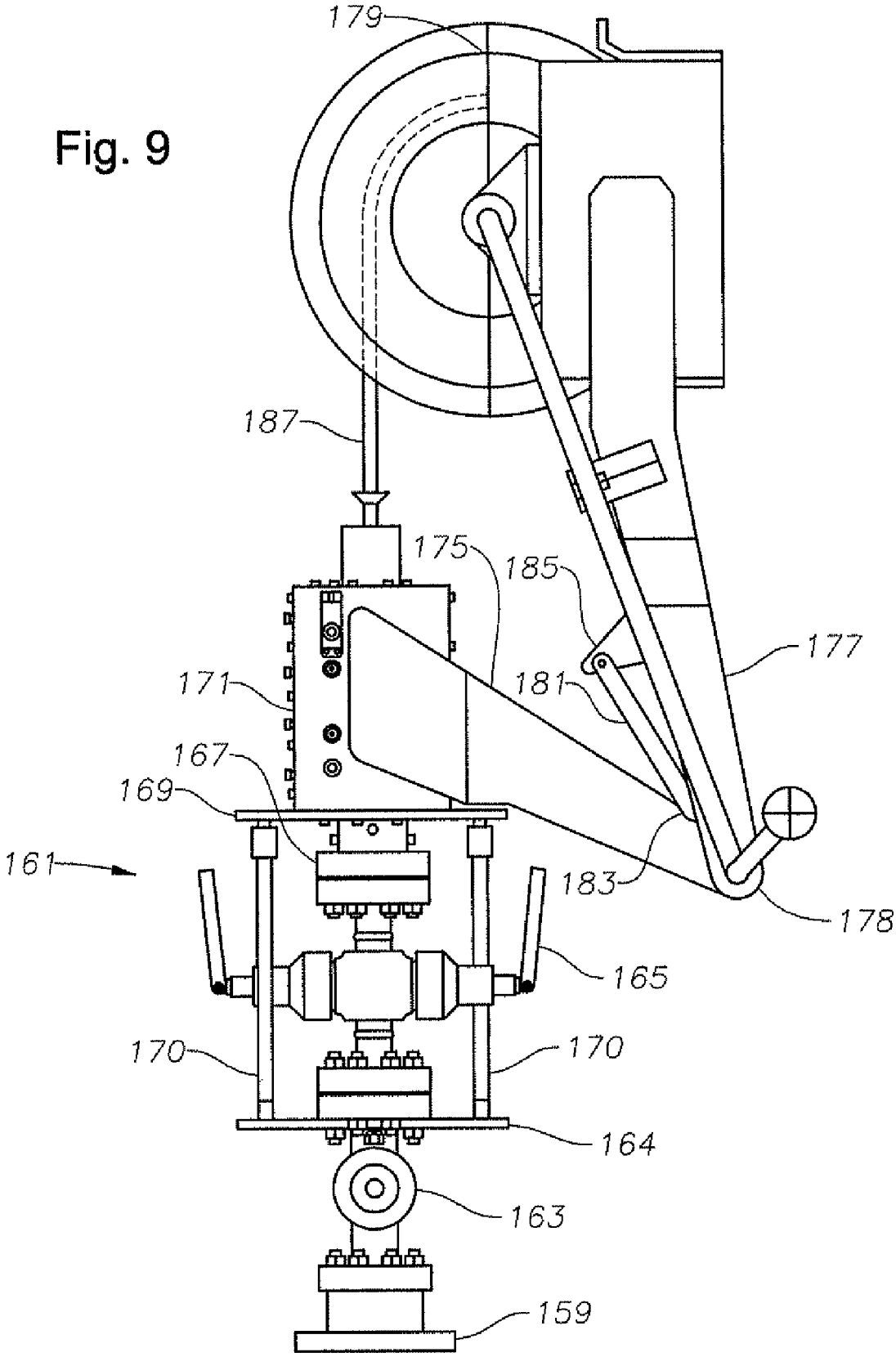
FIG. 9 is a schematic view of a vertical remediation system with lift and hose reel cylinders compressed.
Figure 10:
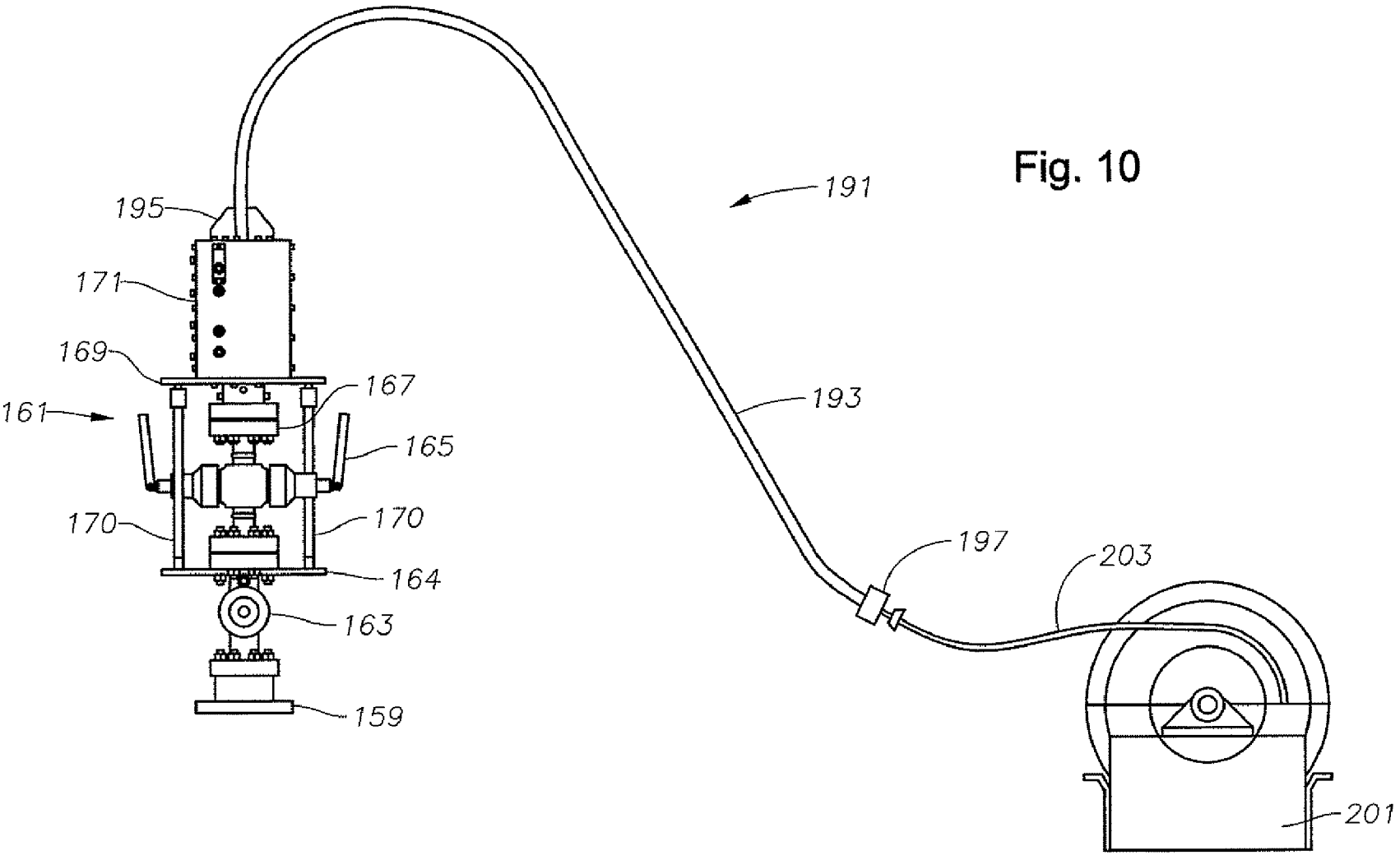
FIG. 10 is a schematic view of a vertical remediation system with a hose reel and a hose guide assembly connected to the remediation system.

FIGS. 8 through 10 illustrate equipment to be implemented with "vertical" entry of CARS equipment. Referring to FIGS. 8 and 9, CARS "vertical" entry equipment 161 is comprised of CARS adapter 159, shear capable valve 163, bottom frame plate 164, BOP 165, cylinders 170, packoff 167, top frame plate 169, and driver 171. Attached to driver 171 is spool positioning equipment 173. Spool positioning equipment 173 is comprised of support arms 175, 177, pivot points 178, 183, 185, cylinder (or other actuator) 181, spool 179, and hose 187.

The CARS equipment 161 is fitted with cylinders 170 in order to raise and lower the packoff 167 and driver 171. With the annular BOP assembly 165 in place, the hose driver 171 will have the packoff 167 attached to it but will not be fixed in its position to the annular BOP assembly 165. The shear capable valve 163 will have a lower mounting plate 164 attached for two lift cylinders 170 on opposite sides of plate 164. The hose driver assembly 171 with the packoff 167 attached will have an upper mounting plate 169 for cylinders 170. As illustrated by FIG. 8, the cylinders 170 will raise the hose driver assembly 171 and packoff 167 for attachment of an articulating weight device (not shown) to the hose 187. The articulating weight device (not shown) can not be sent through the packoff 167 as it will damage the packoff 167. As a result, the hose 187 is allowed to pass through the driver 171 and packoff 167 before the articulating weight device is attached to hose 187. Once the articulated weight device is attached to hose 187, the driver 171 and packoff 167 are lowered by cylinder 170, and the BOP 165 is securely connected to the packoff 167 (FIG. 9).

Referring to FIG. 8, the spool positioning equipment 173 allows the hose spool 179 to be raised and lowered to a desired position. For example, positioning equipment 173 will allow spool 179 to be stored on a deck or level below that of the CARS equipment 161. This lower position permits easier access and service to the hose reel assembly 179. Once the CARS system is ready to be implemented, the spool 179 and hose 187 can be raised to a vertical position directly above driver 171. Support arm 175 is securely attached to driver 171. Support arm 175 is connected to support arm 177 by way of a hinge joint 178. Cylinder 181 also connects between support arm 175 and support arm 177. Cylinder 181 is mounted on support arm 175 with a pivot point 183, and is mounted on support arm 177 with a pivot point 185.

The spool 179 position is determined by extending or retracting cylinder 181. Cylinder 181 could be hydraulically or pneumatically controlled. When cylinder 181 is extended, as in FIG. 8, the spool would be positioned at a level at or below that of CARS equipment 161. When the cylinder is compressed, support arm 177 rotates counterclockwise about hinge joint 178, which in turn raises the spool until it is vertically in line with driver 171 (FIG. 9). When the positioning cylinder is closed, it will bring the hose reel into a position to align the hose with the driver. The hose 187 can then be inserted into the driver 171 and fed into the packoff 167. The spool 178 is lowered in a similar fashion, with cylinder 181 being extended and support arm 177 rotating clockwise about hinge 178.

FIG. 10 illustrates a hose guide assembly 191 for use in a CARS system where the hose reel 201 is placed somewhere remotely, such as, on a platform, or on the ground. The hose 203 is guided into the hose driver 171 by way of a hose guide assembly 191. The guide assembly is comprised of a curved hose guide tube 193 with a pivoting connector 195 on one end and a hose inlet port 197 on the other. The guide tube 193 is constructed of a solid metal, such as steel pipe. Pivoting connector 195 connects the guide tube 193 to the hose driver 171. Connector 195 is flexible and allows for pivoting and motion associated with feeding the hose 203 from reel 201. Inlet port 197 accepts tubing 203 from real 201. The angle of curvature of guide assembly 191 is such that hosing 203 can easily pass through tubing 193 and enter driver 195 with a vertical orientation.

The technique has significant advantages. The angled access adapter will allow legacy wells in the field to be modified to allow for connection of a casing annulus remediation system. The angled access port will allow for the casing annulus remediation system hoses to range in flexibility from flexible to rigid, due to the decreased angle of entry into the annulus. Additionally, the curved access adapters allow for a casing annulus remediation system to be implemented in wells located in environments that limit or prohibit standard horizontal entry.

While the technique has been shown in only one of its forms, it should be apparent to those skilled in the art that it is not so limited but is susceptible to various changes without departing from the scope of the technique.

The invention claimed is:

1. An apparatus for remediating a casing annulus of a well, the well having a wellhead with a longitudinal axis, a lateral port which is substantially perpendicular to the axis, at least one string of casing supported in the wellhead and extending past the lateral port into the well, defining an annulus, the apparatus comprising:

an adapter body having first and second ends, the first end having a planar surface adapted to be in abutting contact with and connected to the wellhead, thereby covering the lateral port, the second end having a planar surface positioned at an angle greater than 0 degrees and up to 90 degrees relative to the first planar surface;

a passage extending from the first end to the second end of the adapter body; and a casing annulus remediation system connected to the second end of the adapter body, the casing annulus remediation system comprising a flexible hose and a hose driver that pushes the hose through the passage and into the casing annulus through an access port extending through a portion of the wellhead adjacent the first end of the adapter body and aligned with the passage.

2. The apparatus of claim 1, further comprising:

a plug preparation, located in the passage adjacent the second end of the body; and a plug, removably positioned within the plug preparation for closing the passage when the casing annulus remediation system is detached from the wellhead.

3. The apparatus of claim 1, further comprising:

a plurality of apertures located in and extending through the planar surface on the first end of the body; and a plurality of bolts each extending into a separate one of the plurality of apertures for connecting the body to the wellhead.

4. The apparatus of claim 1, further comprising:

a plurality of apertures located in and extending through the planar surface on the second end of the body, each of the plurality of apertures receiving a bolt connecting the body to the casing annulus remediation system.

5. The apparatus of claim 1, wherein the passage is straight and free of any junction between the first and second ends.

6. A method for connecting a casing annulus remediation system to a wellhead with a longitudinal axis, a lateral port which is substantially perpendicular to the axis, and at least one string of casing supported in the wellhead and extending past the lateral port into the well, defining an annulus, the method comprising:

(a) providing an adapter with a body having first and second ends, the first end having a planar surface, the second end having a planar surface positioned at an angle greater than 0 degrees and up to 90 degrees relative to the first end;

(b) sealing the annulus from the atmosphere by inserting a first plug into the lateral port;

(c) connecting the first end of the adapter to the wellhead such that the planar surface of the first end substantially covers the lateral port and the first plug;

(d) connecting a valve to the planar surface on the second end of the adapter body;

(e) after the valve is connected, drilling an access port through the wellhead and into the annulus; and (f) connecting the remainder of the casing annulus remediation system to the valve.

7. The method of claim 6, wherein step (a) further comprises:

providing the adapter with a pilot hole located in the planar surface of the second end of the body, perpendicular thereto and adapted to receive a drilling device.

8. The method of claim 6, wherein step (a) further comprises:

providing the adapter with a plug preparation located in the planar surface of the second end of the body; a second plug with an aperture extending therethrough positioned within the plug preparation; and a pilot hole located in the planar surface of the second end perpendicular thereto.

9. The method of claim 8, wherein the access port is an angled access port extending through both the body of the adapter and the wellhead, and wherein step (e) further comprises:

drilling the angled access port from the pilot hole, through the body of the adapter from the second end to the first, through the wellhead, and into the annulus.

10. The method of claim 8, further comprising after step (f):

removing the remainder of the casing annulus remediation system;

removing the second plug through the valve;

inserting a third plug into the plug preparation, thereby sealing the access port and annulus; and disconnecting the valve from the adapter.

11. The method of claim 6, wherein step (c) further comprises bolting the adapter to the wellhead.

12. The method of claim 6, further comprising after step (d), but before step (e):

mounting a drilling device to the valve.

13. The method of claim 12, further comprising after step (e), but before step (f):

closing wellhead side of the valve;

removing the drilling device from the valve;

opening the casing annulus remediation system side of the valve, thereby venting the valve; and removing the drilling device from the valve.

* * * * *